US006666471B2

(12) United States Patent
Gatel

(10) Patent No.: US 6,666,471 B2
(45) Date of Patent: Dec. 23, 2003

(54) PLATFORM FOR RAISING THE BINDING INTENDED FOR FITTING ON A BOARD FOR GLIDING

(75) Inventor: Bernard Gatel, Renage (FR)

(73) Assignee: Skis Rossignol S.A., Volron (FR)

( * ) Notice: Subject to any disclaimer, the term of this patent is extended or adjusted under 35 U.S.C. 154(b) by 149 days.

(21) Appl. No.: 10/083,857

(22) Filed: Feb. 27, 2002

(65) Prior Publication Data

US 2002/0117832 A1 Aug. 29, 2002

(30) Foreign Application Priority Data

Feb. 27, 2001 (FR) ..... 01 02620

(51) Int. Cl.[7] ..... A63C 5/07; A63C 5/00; A63C 9/08

(52) U.S. Cl. ..... 280/602; 280/607; 280/617

(58) Field of Search ..... 280/617, 602, 280/607, 618, 611, 613, 614, 615, 620

(56) References Cited

U.S. PATENT DOCUMENTS

| | | | | | |
|---|---|---|---|---|---|
| 3,398,968 | A | * | 8/1968 | Mutzhas | 280/602 |
| 4,592,567 | A | | 6/1986 | Sartor | 280/602 |
| 4,896,895 | A | | 1/1990 | Bettosini | 280/607 |
| 5,342,078 | A | * | 8/1994 | Stepanek et al. | 280/602 |
| 5,344,176 | A | * | 9/1994 | Trimble | 280/602 |
| 5,551,720 | A | * | 9/1996 | Ruffinengo | 280/602 |
| 5,924,717 | A | | 7/1999 | Janisch et al. | 280/602 |
| 6,142,435 | A | * | 11/2000 | Lodi | 248/222.41 |
| 6,325,404 | B1 | * | 12/2001 | Liard et al. | 280/607 |

FOREIGN PATENT DOCUMENTS

| | | |
|---|---|---|
| DE | 197 18 860 A1 | 11/1998 |
| EP | 0 183 586 A1 | 6/1986 |
| EP | 0 985 433 A1 | 3/2000 |
| EP | 1 166 834 A1 | 12/2001 |

* cited by examiner

*Primary Examiner*—Brian L. Johnson
*Assistant Examiner*—Gerald B. Klebe
(74) *Attorney, Agent, or Firm*—Heslin Rothenberg Farley & Mesiti P.C.; Victor A. Cardona

(57) ABSTRACT

A platform (1) for raising the binding intended for fitting on a board for gliding (4), one free end (6) of which has the ability to slide longitudinally relative to the board, which also comprises:

a stud (20) intended for securing to the board (4) in order to form a fixed point;

a movable member (40) capable of being displaced within the free end (6) of the platform and through the action of the user, said movable member being able to adopt two positions, namely:

a "blocked" position in which it has a portion (43) abutting against the fixed stud (20), so as to prevent the movement of the end (6) of the platform relative to the stud (20);

a "free" position in which it can slide freely relative to the stud (20) and thus allow the longitudinal sliding of the platform (4) relative to the stud (20).

12 Claims, 5 Drawing Sheets

FIG 5
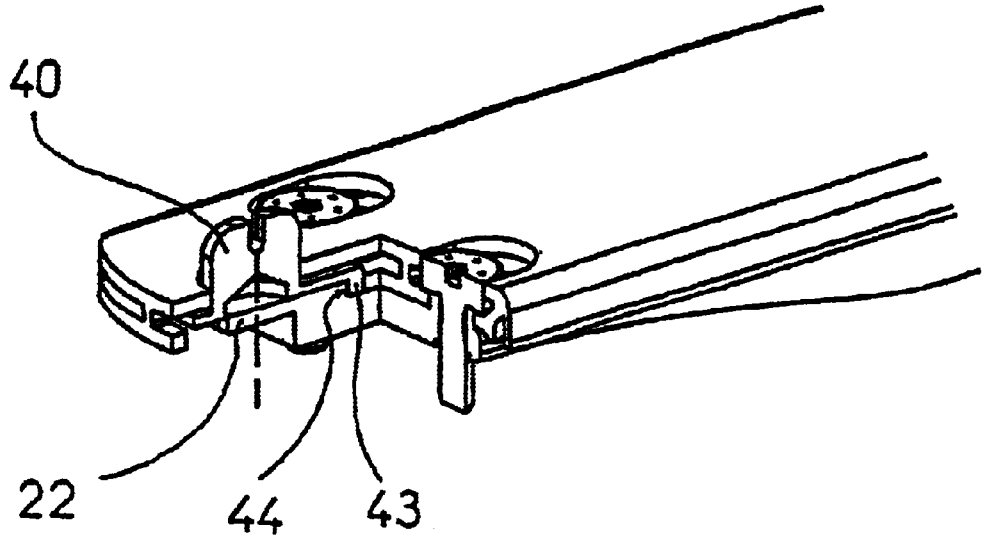
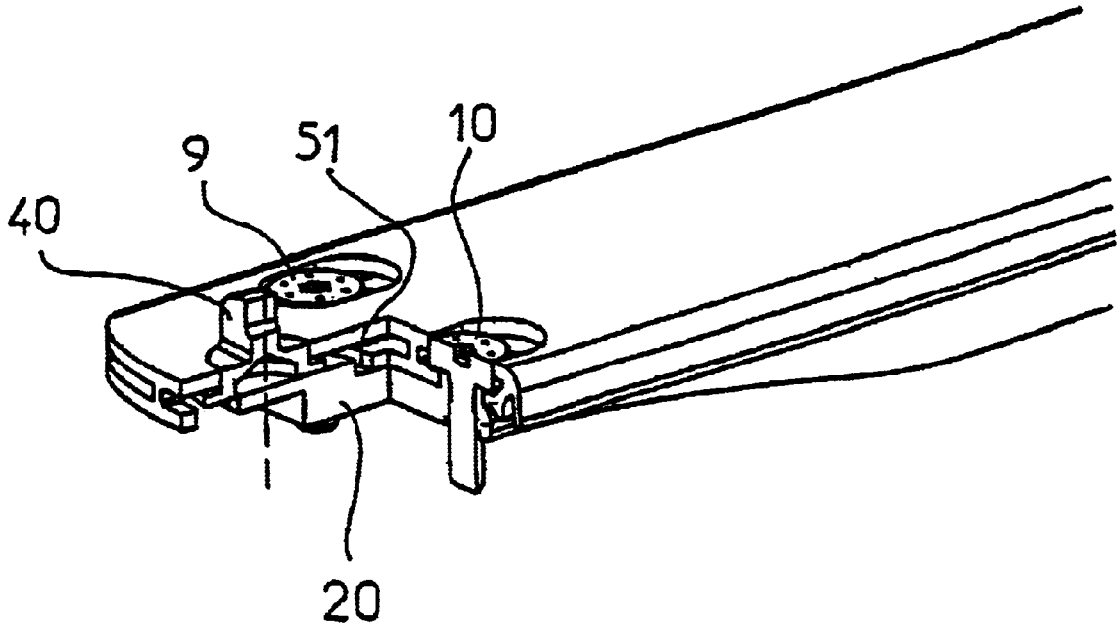
FIG 6

PLATFORM FOR RAISING THE BINDING INTENDED FOR FITTING ON A BOARD FOR GLIDING

CROSS REFERENCE TO RELATED APPLICATIONS

This application claims the priority of French application FR/01.02620, filed Feb. 27, 2001, the entire disclosure of which is incorporated herein by reference.

1. Technical Field

The invention relates to the field of sports involving gliding over snow. It relates more particularly to a device, mounted on a board, which is arranged in order to allow the adaptation of the stiffness of the board as a function of the user's wishes. In the remainder of the description, the invention is more specifically described in its use on an alpine ski, but it could also be applied to snowboards.

2. Prior Art

In a known manner, alpine skis may be equipped with stiffening devices and/or with platforms for raising the binding. A stiffening device is generally formed by a rigid plate anchored on the board at at least two distant points, so that its inherent rigidity is added to that of the board. Such devices, like those described in documents FR 2 534 480 and EP 0 183 586, must of necessity be determined as a function of the intrinsic mechanical properties of the board, and their positioning is particularly sensitive.

Also known are other types of accessory fitted on skis, such as platforms for raising the binding. This type of platform makes it possible, on the one hand, to raise the binding relative to the level of the ski and, on the other hand, to eliminate the influence of the ski boot's stiffness on the intrinsic stiffness of the ski.

Different types of platforms have already been described. The example of such a platform is described in document U.S. Pat. No. 4,896,895. Such a platform consists essentially of a metal plate to which the front stop and the heelpiece of the safety bindings are secured. This metal plate rests on an elastomer layer and is anchored on the board at its two ends, front and rear. One of these ends includes an oblong hole allowing a slight sliding of the platform relative to the board. This device allows damping of some of the vibrations generated on the board and also restriction of the influence of the stiffness of the user's boot relative to that of the board. Such a platform, by obtaining a certain decoupling of the board, has a very small effect on the board's stiffness.

In document EP 1 166 834, the applicant has described a platform for raising the binding which is anchored on the board at three different longitudinal levels. Such a platform, which includes distant anchoring zones, ensures significant coupling of the board when its inherent stiffness is added to that of the board. This type of platform is thus particularly intended for competition or more sports-style skiing, for which it is necessary for the board to have significant stiffness.

It thus appears that the various existing types of platform or stiffener are each more specifically intended for one type of skiing. This therefore obliges manufacturers to design and to produce different skis, depending on their ultimate use. This disadvantage for the manufacturer is combined with a drawback for the ski user or retailer, who has to choose a type of platform or stiffener as a function of the intended skiing style and who has to change it if he wishes to adopt a different style.

In patent application FR 00.14032, which was not published as of the date of filing of the present application, the applicant has already described a raising platform for fitting on a ski, and one end of which has the ability to slide longitudinally relative to the board. This sliding capability is obtained by virtue of an elongate aperture located at one end of the platform.

Inside this elongate aperture passes a fixing screw, the head of which may thus be displaced inside the aperture when the platform is displaced slightly relative to the board. It is possible to allow or prevent this sliding by arranging, inside this elongate aperture, an additional piece which, when present, prevents the movement of the screw inside the aperture and thus blocks sliding.

The use of this additional piece requires the user's intervention, which may be impractical, particularly when the modification is carried out on the snow. Moreover, there is a risk of one of the pieces of the system becoming lost.

Document DE 197 18 860 described another device for fitting on a board for gliding and capable of modifying the stiffness of the board in accordance with an adjustment made by the user. More precisely, this device essentially comprises a platform, the rear end of which has the ability to slide relative to the upper face of the board. This device also includes a movable lever articulated relative to the upper face of the board. A portion of this lever is at the same vertical level as the rear end of the platform and can serve as a stop in order to block the sliding movement of the platform relative to the board. As a function of the position of the lever, this stop effect intervenes at a reasonably early stage during bending of the board.

This device presents a number of drawbacks: it has a complex shape and a multitude of pieces which make it relatively fragile. Moreover, on account of its architecture, this device is the seat of significant mechanical stresses since, irrespective of the position of the articulated lever, the latter undergoes major stresses when it receives the contact of the rear part of the platform.

The invention thus proposes providing a raising platform, the influence of which on the stiffness of the board can be reconfigured at any time by the user, with ease.

SUMMARY OF THE INVENTION

The invention thus relates to a platform for raising the binding intended for fitting on a board for gliding, one free end of which has the ability to slide longitudinally relative to the board.

According to the invention, this platform is defined in that it also includes:

- a stud intended for securing to the board in order to form a fixed point;
- a movable member capable of being displaced within the free end of the platform and through the action of the user, said movable member being able to adopt two positions, namely,
  - a "blocked" position in which it has a portion abutting against the fixed stud, so as to prevent the movement of the free end of the platform relative to the stud;
  - a "free" position in which it can slide freely relative to the stud and thus allow the longitudinal sliding of the platform relative to the stud.

In other words, the region of the platform which has the ability to slide relative to the board may be blocked in a fixed position relative to the board through the action of the user, who modifies the position of the movable member so that the latter may or may not interact with the stud that is fixed relative to the board.

Thus, when the movable member is in the blocked position, the said member interacts with the fixed stud so as to prevent the displacement of the end of the platform. The platform thus adds its stiffness to that of the board. Conversely, when the movable member is in the "free" position, it does not interfere with the fixed stud during the sliding of the platform. The stiffness of the platform thus has only a very limited influence on the overall stiffness of the board.

In practice, the movable member may be displaced relative to the platform either by means of pivoting or by means of translation.

In a particular embodiment, when the movable member is in the blocked position, the portion abutting against the stud is directed against the end of the platform so as to prevent the sliding of the latter in the direction oriented toward its end. In other words, when it is the rear end of the platform that has the ability to slide, the movable member is in abutment relative to the front face of the stud, so as to prevent the rear end of the platform moving back.

Conversely, if is the front end which has the ability to slide, it will be preferred for the sliding member to be in abutment with the rear face of the fixed stud, to prevent sliding of the platform toward the front of the ski.

In a particular embodiment, the movable member may comprise a second portion abutting against the stud when the movable member is in the blocked position, so as to prevent the movement of the end of the plate relative to the stud in both longitudinal directions. In other words, in the blocked position, the displacement of the sliding end of the plate relative to the board is prevented, both to the front and to the rear.

This arrangement is of interest when, in its rest position, i.e. under the static load of the user, the platform is in an intermediate position relative to the board, i.e. it has the ability to slide either toward the front or toward the rear.

Advantageously, in practice, if the movable member can pivot relative to the platform, the mutually abutting zones of the stud and of the movable member are cylindrical. In this way, during pivoting of the movable member relative to the stud, the two cylindrical profiles of the stud and of the movable member slide relative to one another.

In practice, the movable member may be fitted in a housing provided for this purpose under the platform, which limits the overall height of the device.

According to another characteristic of the invention, the platform may also include return means interposed between the platform and the movable member. These said means are capable of pressing the movable member against the stud in a direction perpendicular to the plate. In other words, the return means are provided in order to maintain contact and interaction between the movable member and the stud in order to ensure, in particular, the permanent nature of blocking, particularly when the movable member abuts against the stud.

Advantageously, in practice, the platform may include at least one longitudinally elongate aperture inside which a point for anchoring on the board, such as, in particular, a screw, is capable of sliding. In this case, the characteristic stud is secured to the board by this anchoring point which may, for example, pass through a part of the front stud before being screwed inside the structure of the board.

According to another characteristic of the invention, the stud or movable member may have means for preventing the free displacement of the movable member, i.e. to hold the movable member either in the "blocked" position or in the "free" position. In other words, the position of the movable member may be locked in order to prevent it being displaced unexpectedly during use.

In practice, these means for preventing the free displacement may be formed by bosses present on the stud and intended for interacting with at least one edge of the portion of the movable member abutting against said stud. In other words, these bosses form zones of excess thickness that the movable member has to surmount in order to pass from the free position to the blocked position, and vice versa. The effort needed to pass from one position to the other must require intervention on the part of the user and cannot be the result of mere vibrations.

In another embodiment, the means for preventing the free displacement of the movable member include a spring leaf integral with the stud interacting with a portion of the movable member. The two "free" and "blocked" positions correspond to configurations in which the spring leaf is practically not under stress. On the other hand, in order to pass from one position to the other, it is necessary to exert a minimum effort which is sufficient to counter the effect of this spring leaf. This minimum effort is determined so that there is no unexpected displacement of the movable member.

BRIEF DESCRIPTION OF THE FIGURES

The way in which the invention is embodied and the advantages arising therefrom will become clearly apparent from the description of the following embodiments, supported by the appended figures, in which:

FIG. 5 is a summary perspective view in cutaway of the rear end of the platform of FIG. 1, in which the movable member is in the blocked position;

FIG. 6 corresponds to FIG. 5, in which the movable member is in the free position;

IMPLEMENTATION OF THE INVENTION

As already stated, the invention relates to a raising platform for fitting on a board for gliding, such as an alpine ski, and which receives the mounting of the front stop and the heelpiece of the safety binding.

Figure 1:
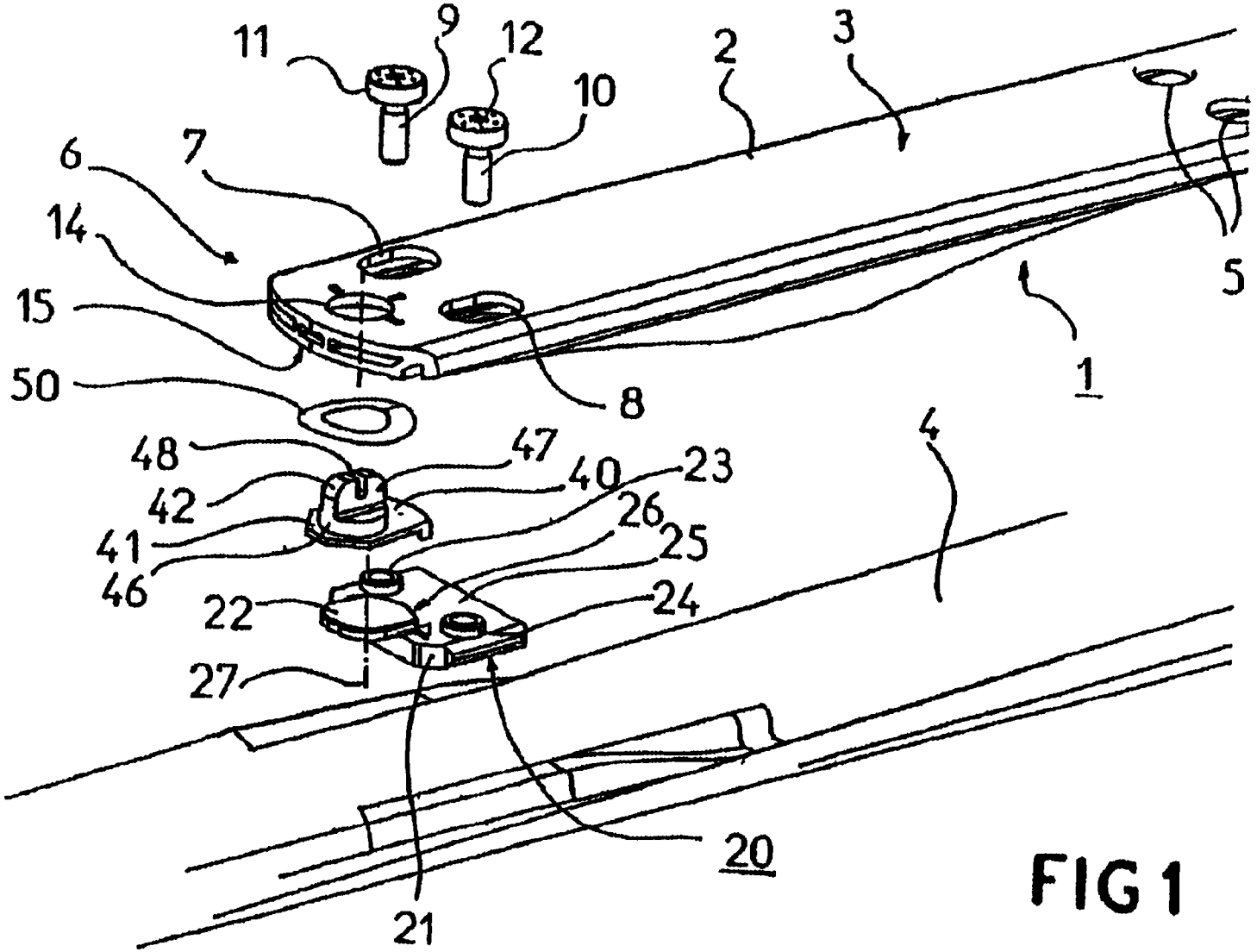
FIG. 1 is an exploded view of the rear end of a raising platform according to the invention and of the zone of the ski where it is fitted.

In the illustrative embodiment shown in FIG. 1, this platform (1) comprises a metal plate (2), of which the upper face (3) is intended for receiving the front stop and the heelpiece of the binding (not shown).

In the embodiment illustrated, the platform (1) is secured to the board (4) at its front end (not shown) and at its center by means of two screws passing through circular apertures (5) produced through the metal plate (2). In this way, the attachment of the front end and of the center of the platform is achieved without there being any capability to slide relative to the board.

Conversely, the rear end (6) of the platform (1) is equipped with two longitudinally elongate openings (7, 8). These two elongate openings (7, 8) receive two screws (9, 10) which pass through, screwed inside the board (4).

The heads (11, 12) of these screws (9, 10) have a diameter which is substantially equal to the width of the elongate apertures (7, 8). However, this diameter is smaller than the length of these elongate apertures (7, 8), which allows a slight longitudinal sliding of the platform relative to the board where the screws (7, 8) are anchored in the board.

According to the invention, this platform (1) also comprises a stud (20) which is mounted fast relative to the ski, and also a movable member (40) accessible to the user.

More precisely, and as illustrated in FIG. 1, this stud (20) has a small plate (21) which comes into contact with the upper face of the ski (4), and a zone in the form of an excroissance (22) forming the stud proper.

More precisely, the small plate (21) has two drill holes (23, 24) traversed by the anchoring screws (9, 10), so that the small plate (21) and therefore the stud (22) are firmly secured to the board (4) and thus constitute a fixed point relative to it. At the rear, this small plate (21) is extended by a zone in the form of an excroissance (22) which starts on the upper face (25) of the small plate (21). This excroissance (22) is located to the rear of the small plate (21) and has a substantially square shape. The front side (26) of this excroissance (22) has a cylindrical profile, centered on the pivoting axis (27) of the movable member (40).

This movable member (40), as illustrated in FIG. 1, includes three principal zones, namely:

- a substantially flat and horizontally oriented central zone (41);
- a high zone (42) serving as an operating lever for displacing the movable member (40);
- and a front zone (43) forming the stop which is intended for coming into contact with the stud (20).

More precisely, the central zone (41) is extended to the front by the front zone (43), which has a general cylindrical shape, with a diameter that is slightly larger than the diameter of the front side (26) of the stud (22).

This front zone (43) has a height which is substantially equal to the height of the characteristic stud (22). The rear face (44) of the front zone (43) of the movable member (40) comes into contact with the front face (26) of the stud (22) when the movable member (40) is in the blocked position, as illustrated in FIG. 1.

The upper zone (42) of the movable member (40) is broken down into a cylindrical first part (46), directly located above the flat central zone (41). This cylindrical zone (46) has a diameter corresponding to that of an opening (14) drilled on the plate (2). This cylindrical portion (46) is extended upward by a gripping zone (47) which may be grasped by the user in order to pivot the movable member (40). This gripping zone (47) may also have a transverse slot (48) allowing the use of a screwdriver or equivalent tool to pivot the movable member (40).

In the embodiment illustrated in FIG. 1, the platform also comprises a crinkle washer (50) which is interposed between the movable member (40) and the plate (4). More precisely, this crinkle washer (50) is located between the upper face of the central zone (41) of the movable member (40) and the lower face (15) of the plate (4). This crinkle washer (50) or, more generally, any spring or return system, exerts a force separating the movable member (40) from the plate (4) and thus presses the movable member (40) onto the stud (20).

Figure 2:
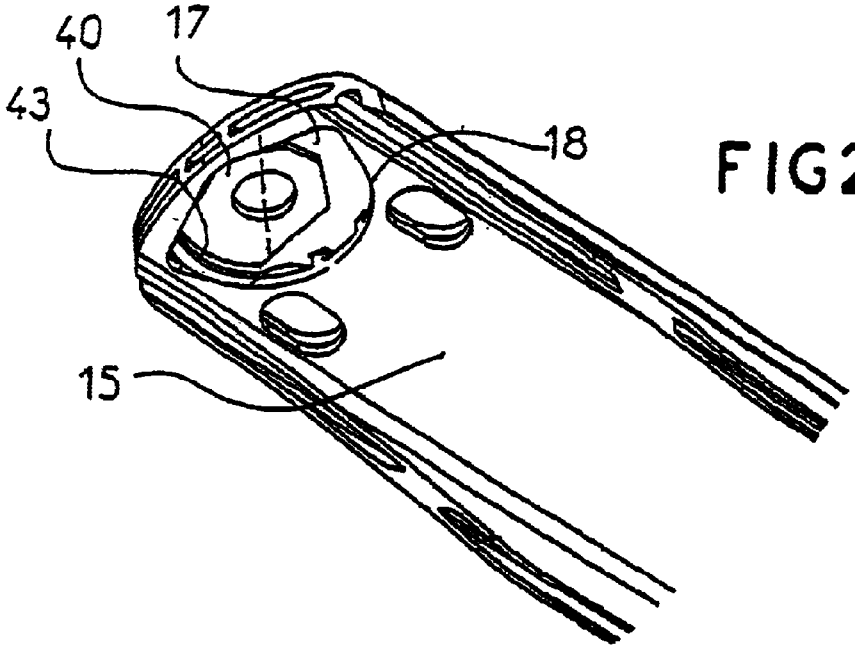
FIG. 2 is a summary perspective bottom view of the platform of FIG. 1 solely equipped with the movable member, shown in the free position.
Figure 3:
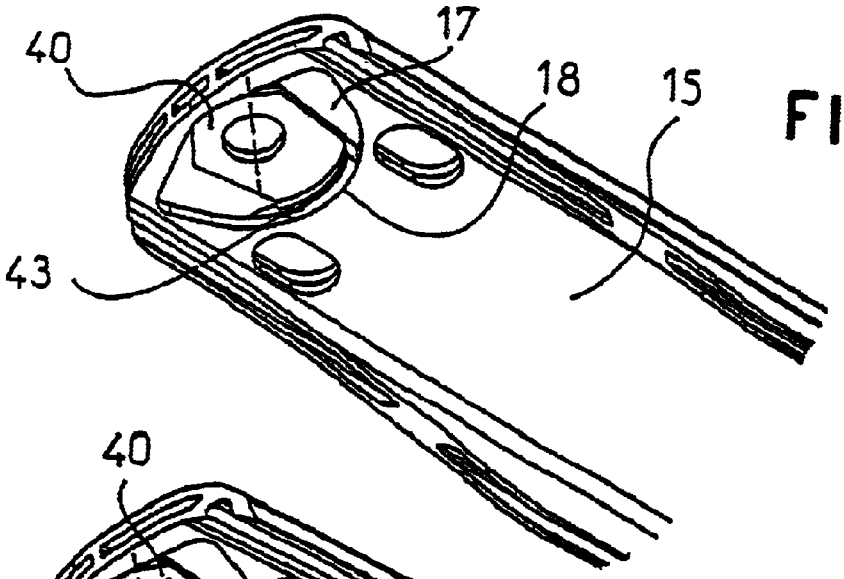
FIG. 3 is a bottom view identical to that of FIG. 3, in which the movable member is shown in the blocked position.
Figure 4:
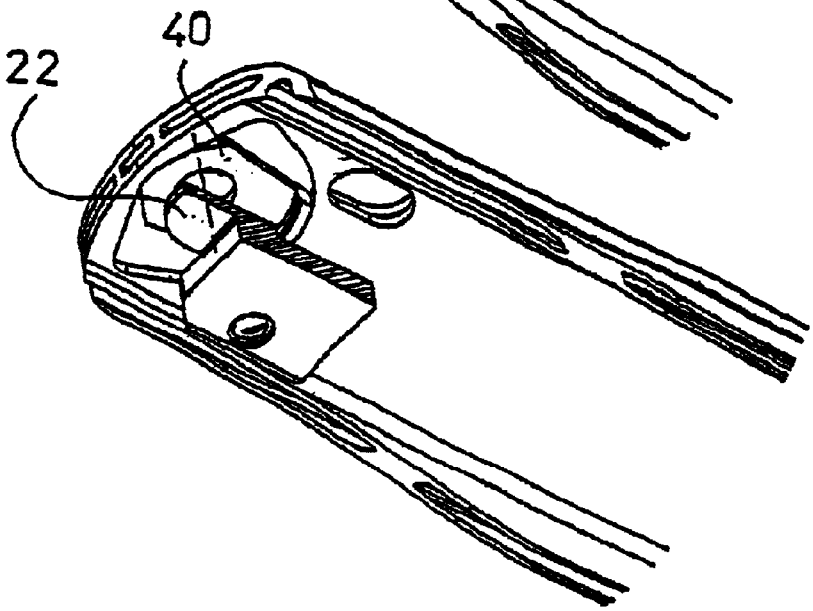
FIG. 4 is the same perspective view as that of FIG. 3, in which a part of the fixed stud is also shown.

As illustrated in FIGS. 2 to 4, the movable member (40) is fitted under the plate (4) in a housing (17) provided for this purpose. This housing (17) has a general shape which allows the pivoting of the movable member (40) through 180°, i.e. between the position illustrated in FIG. 2, corresponding to the free position, as far as the position illustrated in FIG. 3, corresponding to the blocked position, or even as far as a position which is not shown but which corresponds to a pivoting of the movable member through an additional 90°, in which the movable member (40) is in a symmetrical position relative to its axis of rotation, compared to the representation of FIG. 2.

In the embodiment illustrated, the front zone (43) of the movable member (40) comes practically into contact with the border (18) of the housing made in the plate in order to eliminate mechanical play.

Moreover, the height of the front zone (43) of the movable member (40) is such that the latter is flush under the lower face (15) of the plate (4), without jutting out.

As illustrated in FIG. 4, the portion in the form of an excroissance (22) of the fixed stud (20) also penetrates inside the housing (17) made in the plate (4).

In order to facilitate understanding, only half of the fixed stud (20) has been shown in this figure.

The platform according to the invention functions as follows.

Figure 8:
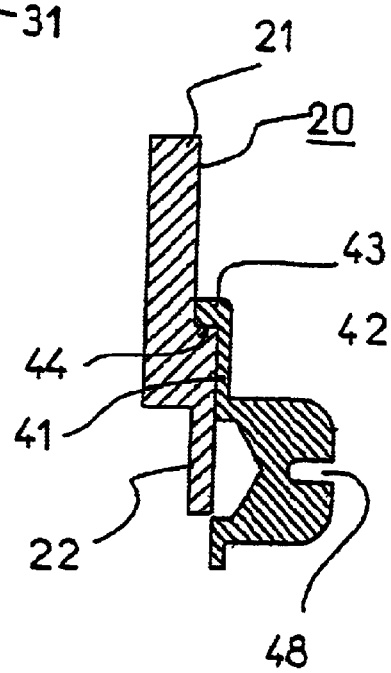
FIG. 8 is a sectional view along the plane VIII—VIII' of FIG. 7.
Figure 9:
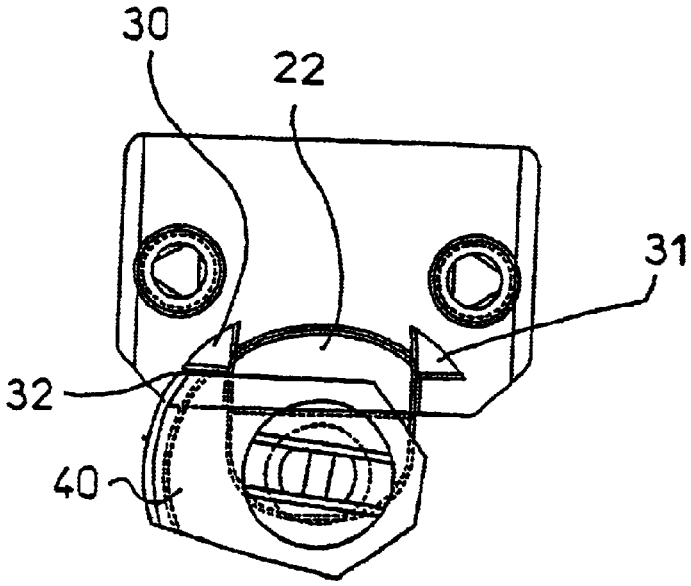
FIG. 9 is a top view corresponding to FIG. 7, in which the movable member is in the "free" position.

As illustrated in FIG. 5, when the movable member (40) is in the "blocked" position, the front zone (43) of the movable member (40) is located in the central longitudinal plane of the plate (4). The rear face (44) of this front zone (43) comes into contact with the characteristic stud (22). This configuration is also illustrated in FIGS. 8 and 9. The rear end (6) of the plate (4) thus, via this characteristic portion, abuts against the fixed stud (20). It is thus impossible for the platform (1) to slide rearward when the board bends. In other words, the rigidity of the board is increased by that of the platform.

Conversely, when the movable member (40) is in the position illustrated in FIG. 6, after having been pivoted through 90°, the front portion (43) of the movable member (40) is located in a lateral zone of the platform and thus is hidden in FIG. 6. This position corresponds in top view to the representation of FIG. 9. In this case, the movable member (40) can be displaced longitudinally relative to the stud (20) without abutting against the latter. In other words, the space (51) located between the front face (26) of the stud (22) and the border (18) of the housing (17) made in the plate (4) is able to diminish.

This occurs when the board bends and when the rear end (6) of the platform is pushed rearward, sliding relative to the anchoring points formed by the screws (9, 10). In this case, the screws (9, 10) are displaced toward the inside of the elongate apertures (7, 8) in the direction of the front of the platform when the board bends. Thus, the influence of the stiffness of the platform on that of the ski is more limited.

Figure 7:
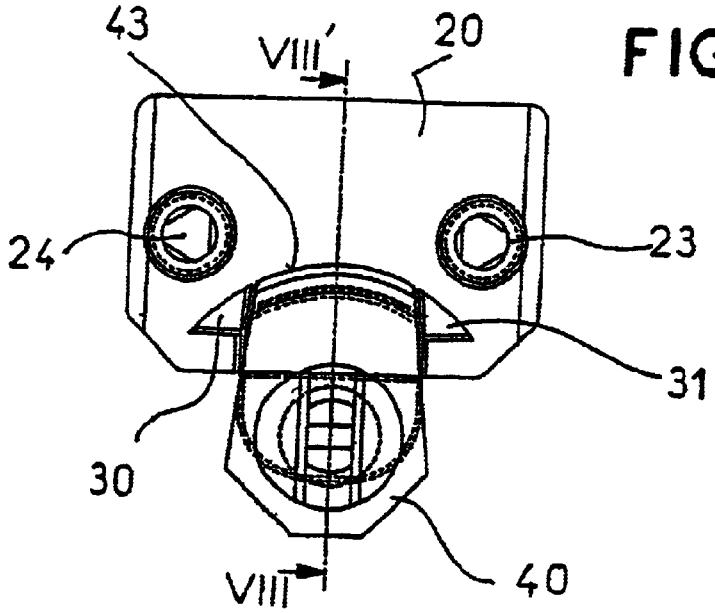
FIG. 7 is a top view of the stud and of the movable member shown in the blocked position.

As illustrated in FIGS. 7 and 9, the characteristic stud includes two bosses (30, 31) located on either side of the central longitudinal plane. These bosses (30, 31) are separated by a distance corresponding substantially to the width of the front zone (43) of the movable member (40). In this way, when the movable member is in the blocked position illustrated in FIG. 7, these bosses (30, 31) oppose the free pivoting of said member. In order to pass from the blocked position to the free position, i.e. from the position illustrated in FIG. 7 to that illustrated in FIG. 9, it is necessary for the front zone (43) of the movable member to surmount the boss (30). When the movable member (40) is in the "free" position, the face (32) of the boss (30) opposes its displacement in the direction of the blocked position. This thus eliminates the risk of the movable member (40) being displaced unexpectedly during use, which could generate undesired changes in stiffness. In this case, with the washer (50) pressing the movable member (40) downward, the user will have to exert a slight upward pulling action on the latter to make it pivot.

Obviously, the locking function of the bosses may be achieved by equivalent means, such as return spring leaves arranged at suitable points in order to lock the movable member in its free and blocked positions.

Figure 10:
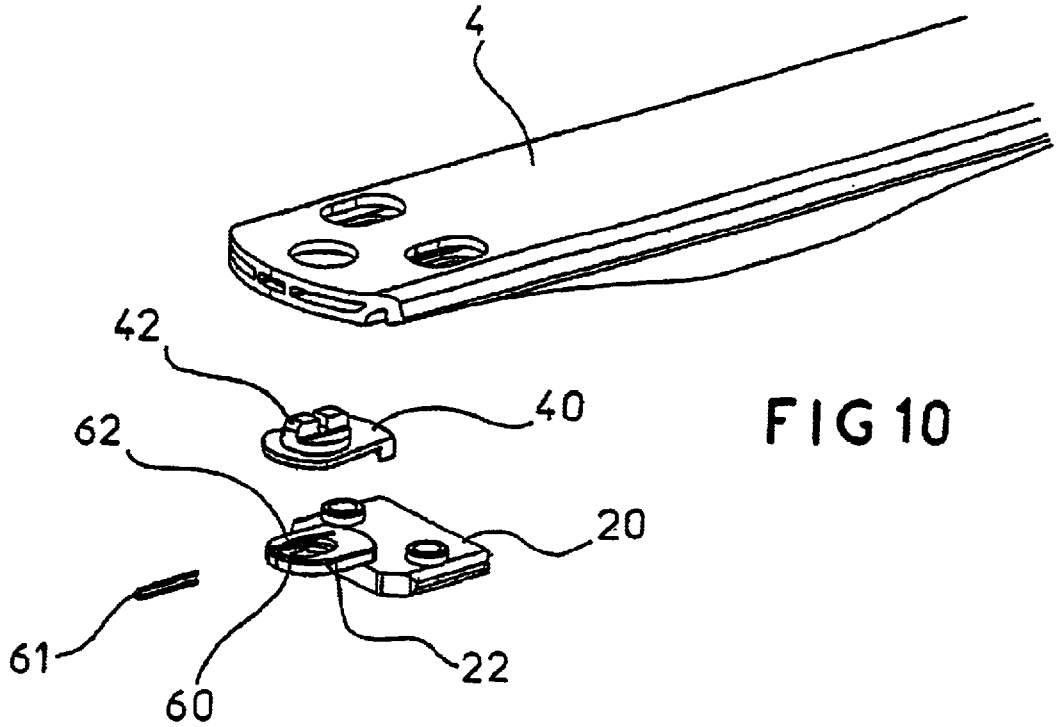
FIGS. 10 and 11 are, respectively, top and bottom exploded views of a variant embodiment of the platform.
Figure 11:
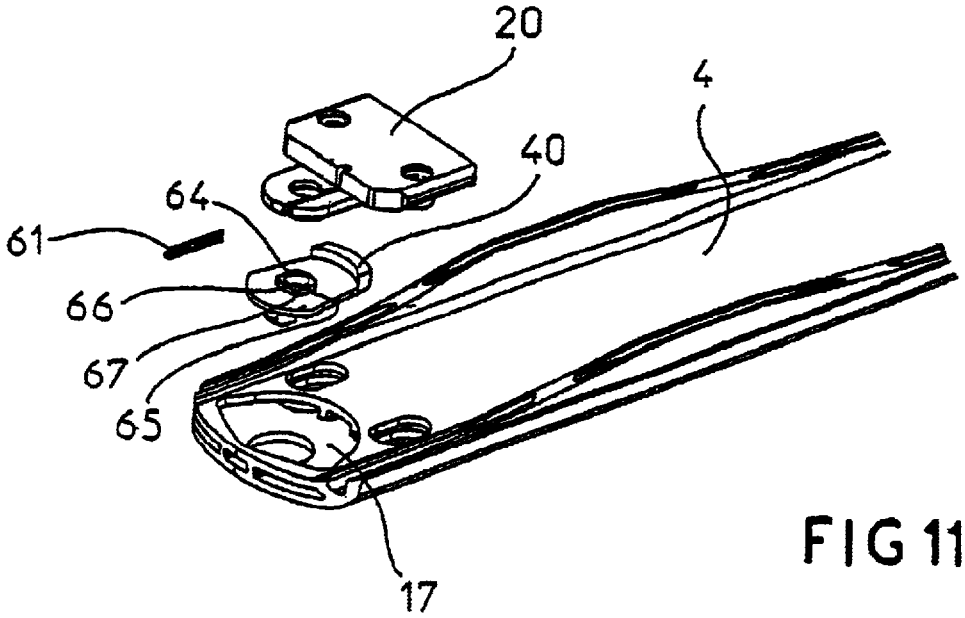

More precisely, and as illustrated in FIGS. 10 and 11, the part in the form of an excroissance (22) of the stud (20) may include a housing (60) of oblong general shape. This oblong housing (60) has its larger dimension along the longitudinal axis of the board. This housing (60) receives, on one of these lateral faces, a spring (61) formed from a steel rod or of the piano-wire type configured in the shape of a U. This spring (61) has the ability to deform transversely and is thus slightly separate from the side (62) of the housing (60) opposite which it is located. This housing (60) receives a portion in the form of an excroissance (64) located under the central zone (41) of the movable member (40). This portion in the form of an excroissance has a square general shape.

Generally speaking, this portion in the form of an excroissance has two substantially rectilinear sides (65, 66) oriented at 90° to one another. These two sides (65, 66) face the spring (61) in one or other of the two positions—blocked or free—of the movable member (40). More precisely, and in the embodiment illustrated, when the movable member (42) is in the blocked position, the side (65) of the portion (64, 65) comes into contact with the spring (61). In order to pass into the free position, it is necessary to rotate the movable member (40) through 900. During this movement, the corner (67) of the portion in the form of an excroissance (64), located at the intersection of the sides (65, 66), deforms the spring leaf (61) which opposes this movement.

The force needed to deform this spring leaf (61) must require the intervention of the user and cannot merely be the result of vibrations. When the corner (67) leaves the spring leaf (61), the side (66) of the excroissance (64) is located opposite the spring (61).

In order to return to the blocked position, it is once again necessary to exert sufficient force, which cannot arise accidentally.

Of course, the general shape of the excroissance (64) may be different than that illustrated, provided it blocks the movable member (40) in the two—blocked and free—positions.

The invention is described above in detail in the case of an embodiment in which the movable member pivots about a vertical axis, but is also covers variants in which the movable member is displaced by horizontal or vertical translation, provided the principle of the invention is respected, i.e. provided this movable member is able to adopt two positions, one in which it blocks or more generally limits the movement of the end of the platform and another position in which the sliding of the platform is free.

It emerges from the aforesaid that the platform according to the invention offers numerous advantages and, in particular, the possibility of an adjustment of the stiffness of the board by the user, with ease.

What is claimed is:

1. A platform system for raising a binding for fitting on a board for gliding, one free end of a platform being adapted to slide longitudinally relative to the board, said system comprising:

a stud for securing to the board to form a fixed point;

a movable member adapted to be displaced within the free end of the platform, said movable member being adapted to be moved between two positions by a user, said positions comprising, a blocked position wherein a portion of said movable member abuts the fixed stud, to inhibit movement of the free end of the platform relative to the stud; and a free position wherein said moveable member is adapted to slide freely relative to the stud to allow the longitudinal sliding of the platform relative to the stud.

2. The platform as claimed in claim 1, wherein the movable member is capable of pivoting relative to the platform.

3. The platform as claimed in claim 1, wherein the movable member is capable of being translated relative to the platform.

4. The platform as claimed in claim 2, wherein the abutting portion is directed, when the movable member is in the blocked position, against the end of the platform so as to prevent the sliding of the latter in the direction oriented toward its end.

5. The platform as claimed in claim 2, wherein, in their zones abutting against one another, the stud and the portion of the movable member are cylindrical.

6. The platform as claimed in claim 1, wherein the movable member comprises a second portion abutting against the stud when the pivoting member is in the blocked position, so as to prevent the movement of the end of the plate relative to the stud in both longitudinal directions.

7. The platform as claimed in claim 1, wherein the movable member is partially fitted in a housing provided for this purpose.

8. The platform as claimed in claim 1, which also comprises return means interposed between the platform and the movable member and which are capable of pressing the movable member against the stud in a direction perpendicular to the plate.

9. The platform as claimed in claim 1, which includes at least one longitudinally elongate aperture inside which a point for anchoring on the board is capable of sliding, and wherein the stud is secured to the board by said anchoring point.

10. The platform as claimed in claim 1, wherein the stud or the movable member or both has or have means for preventing the free displacement of the movable member.

11. The platform as claimed in claim 10, wherein the means for preventing the free displacement are formed by bosses present on the stud and intended for interacting with at least one edge of the portion of the movable member abutting against the stud.

12. The platform as claimed in claim 10, wherein the means for preventing the free displacement includes a spring leaf integral with the stud interacting with a portion of the movable member.

* * * * *

UNITED STATES PATENT AND TRADEMARK OFFICE

CERTIFICATE OF CORRECTION

PATENT NO. : 6,666,471 B2
DATED : December 23, 2003
INVENTOR(S) : Gatel

It is certified that error appears in the above-identified patent and that said Letters Patent is hereby corrected as shown below:

Title page,
Item [73], Assignee, delete the word "Volron" and insert -- Voiron --

Signed and Sealed this

Twenty-fourth Day of February, 2004

JON W. DUDAS
*Acting Director of the United States Patent and Trademark Office*